United States Patent [19]

Hellner et al.

[11] Patent Number: 4,644,867

[45] Date of Patent: Feb. 24, 1987

[54] SHELL CASE WITH NON-COMPRESSIBLE FRAGMENTS METALLURGICALLY BONDED TO THE CASING

[75] Inventors: Lars Hellner; Ingemar Haglund; Torsten Rönn; Kjell Albrektsson, all of Karlskoga, Sweden

[73] Assignee: Aktiebolaget Bofors, Sweden

[21] Appl. No.: 714,283

[22] Filed: Mar. 21, 1985

[30] Foreign Application Priority Data

Apr. 2, 1984 [SE] Sweden ..... 8401792

[51] Int. Cl.[4] ..... F42B 13/48

[52] U.S. Cl. ..... 102/495; 102/496; 102/506; 102/519; 419/8

[58] Field of Search ..... 102/491, 497, 506, 519; 419/8

[56] References Cited

U.S. PATENT DOCUMENTS

| | | | |
|---|---|---|---|
| 3,489,088 | 1/1970 | Von Ballmoos et al. | 102/496 |
| 3,768,414 | 10/1973 | Polcha | 102/67 |
| 3,815,504 | 6/1974 | Tieben | 102/67 |
| 3,974,771 | 8/1976 | Thomanek | 102/494 |
| 4,032,335 | 6/1977 | Zapf et al. | 102/496 X |
| 4,129,061 | 12/1978 | Bedall et al. | 86/20 B |
| 4,383,468 | 5/1983 | Sie et al. | 102/496 X |
| 4,503,776 | 3/1985 | Nussbaum et al. | 102/496 |

FOREIGN PATENT DOCUMENTS

| | | |
|---|---|---|
| 1931650 | 1/1971 | Fed. Rep. of Germany . |
| 1943472 | 3/1971 | Fed. Rep. of Germany . |

*Primary Examiner*—Peter A. Nelson

*Attorney, Agent, or Firm*—Pollock, Vande Sande & Priddy

[57] ABSTRACT

A shell case comprising prefabricated fragments (4), preferably of a material with high density, and a supporting material which surrounds the fragments and together with these forms a connected shell which surrounds the explosive of the shell. The supporting material consists of a completely dense non-compressible material which is permanently connected with the prefabricated fragments, for instance a hardenable steel. The shell is preferably manufactured by a powder metallurgical procedure in which the supporting material in the form of a metal powder together with the pre-fabricated fragments (4) are pressed under high all-round pressure and high temperature into a dense compact jacket.

9 Claims, 3 Drawing Figures

SHELL CASE WITH NON-COMPRESSIBLE FRAGMENTS METALLURGICALLY BONDED TO THE CASING

The present invention relates to a shell case containing pre-shaped fragments, preferably of a material with high density, and a material surrounding the fragments which together with the fragments forms a connected jacket which surrounds the explosive in the shell. The invention also relates to a method of manufacturing such a shell case.

BACKGROUND OF THE INVENTION

Already known through British patent specification No. 1 245 906 is an explosive shell case with pre-shaped fragments, preferably in the form of balls of metal with high density, which are baked into a suitable plastic between a metallic inner and outer sleeve.

Since the shell must be able to absorb high pressures from the propellant charge and high centrifugal forces from the rotation of the shell, i.e. both axial and radial forces, exacting demands are imposed on the strength of the shell case. The material in the shell shall also be able to function upon detonation of the shell as a propelling surface for the pre-shaped fragments and contribute to their acceleration to a high and uniform velocity.

These requirements have, however, been difficult to combine. In the aforesaid explosive shell case, for example, the metallic outer sleeve imparts higher strength to the shell but at the same time prevents an increase in the velocity of the fragments upon detonation of the shell, which is a disadvantage.

In recent times, therefore, several different solutions have been proposed in order to provide a shell case which is sufficiently strong to absorb both axial and radial forces to which the shell is exposed but in which the fragmentation effect is nevertheless the greatest possible.

Proposed in the published Swedish patent application No. 72.07166-5, for example, is a fragment case produced in such a way that prefabricated fragments are pressed in through high-pressure deformation between concentrical tubes. Described in Swedish patent specification No. 76.09596-7 is a procedure for the manufacturing of a fragment case in which the fragments are baked into a fine-pore, compressible, sintered mantle and in the German Offenlegungsschrift No. 19 43 472 a fragment case is shown in which the fragments are included in a supporting sintered mantle but with residual cavities between the fragments which are possibly filled with a light material such as aluminium or plastic. Finally, described in the published Swedish patent application No. 77.02160-8 is a fragment case in which the fragments are pressed into a supporting frame of material made age-hardenable through sintering which surrounds the fragments on all sides of a solid shell base body.

In all of these examples the pre-shaped fragments are surrounded by partly soft or porous compressible material. A material of this nature facilitates baking in of the pre-shaped fragments but is not an ideal material with regard to either strength properties or ability to accomplish an effective fragmentation effect.

The object of the present invention is therefore to provide a shell case with good strength properties and a higher fragmentation effect. The invention is characterized to this end largely in that the material surrounding the fragments consists of a completely dense non-compressible material which is firmly united with the pre-shaped fragments.

According to one preferred embodiment of the invention the material surrounding the fragments (the carrying material) consists of a hardenable steel which, in course of manufacturing, is bonded to the fragments and together with these forms a connected jacket which surrounds the explosive in the shell.

The method of manufacturing the shell case is characterized largely in that the prefabricated fragments are imparted a permanent connection with the material in the case whereupon the shell blank is imparted its final properties through heat treatment.

According to one advantageous embodiment the case is made by a powder metallurgical procedure in which the material of the case in the form of a metal powder together with the prefabricated fragments is pressed under high all-round pressure and high temperature into a tight, compact jacket.

DESCRIPTION OF THE FIGURES

The invention will now be described in detail and with reference to the accompanying drawing which shows some different embodiments of the invention and wherein.

DESCRIPTION OF THE PREFERRED EMBODIMENTS

Figure 1:
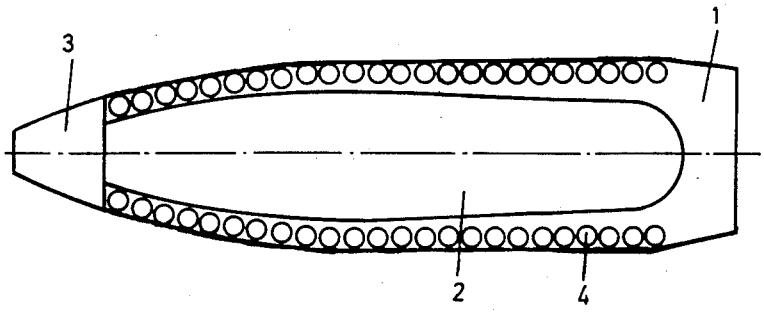
FIG. 1 shows a longitudinal section through a shell body according to the basic design of the invention.

Shown in FIG. 1 is a longitudinal section through a shell base body which comprises a case 1 which surrounds a space 2 for the explosive charge in the shell. The nose portion 3 of the shell contains a fuze or the like for detonation of the shell. In order to achieve the fragmentation effect the case 1 of the shell contains a plurality of pre-shaped fragments 4 which are baked into the case material. The fragments are liberated upon detonation of the shell and accelerated to such a high and uniform velocity as possible in order to achieve effective damage effect within a predetermined area.

The explosive shell case 1 has several functions to fulfil. It must be able to absorb axial forces and resist the pressure from the propellant charge of the shell. It must also be able to absorb radial and tangential forces caused by the rapid rotation of the shell and to resist the centrifugal forces acting on the case and the fragments embedded therein. The shell case shall also be able to anchor and support one or several driving bands and possible guide ridges. The shell case should otherwise be as thin and light as possible in order for the ballast to be the smallest possible. The case should also be so designed that the fragmentation effect of the shell is as effective as possible, i.e. that the fragments are accelerated to a high and uniform velocity.

In order to increase the fragmentation effect the material in the shell case surrounding the fragments 4 consists of a completely dense non-compressible material such as hardenable steel, which is connected to the pre-shaped fragments and together with them forms a connected jacket which surrounds the explosive in the space 2. The material in which the pre-shaped fragments 4 are embedded shall thus, in contrast to what is previously known and applied, be in principle non-compressible. An example of such a hardenable steel that can be used to advantage is the previously standardized Swedish steel SIS No. 2536. The object of a completely dense non-compressible case is to increase the elastic energy which can be stored in the case and which is liberated upon bursting. This elastic energy is the most important component to give a high efficiency of the propelling surface. The material should have a porosity which is less than 0.1 percent. The prefabricated fragments 4 are included in the case as supporting elements. In this instance they consist of balls but may also have the shape of cubes or other type of compact bodies and be made appropriately of material with high density. Common materials are heavy metals such as tungsten, but other heavy metals may also be used. Also other fragment materials, e.g. with igniting properties, may be used. The portion of the case which lies beyond the fragments prevents an increase in the velocity of the fragments upon detonation of the shell. It is therefore a major advantage of the present invention that the fragments by being bound to the surrounding material can themselves support a portion of the forces arising upon firing. The binding forces are, however, not so great as to prevent separation of the fragments upon detonation, appropriately being 50–90 percent of the tensile strength of the fragments. The case can thereby be made thinner and, in particular, the outer velocity-reducing layer can be made very thin or even completely eliminated. In FIG. 1, the thickness of the case is thus limited to largely the diameter of the fragment balls except beneath and behind the driving band where the strength and toughness requirements are highest and where the case is thicker. Even here, however, the fragments are placed adjacent to the outer surface of the case to minimize the outer velocity-reducing layer.

As mentioned heretofore the prefabricated fragments may have different shapes such as balls, cubes etc. The prefabricated fragments may also be of different types in different portions of the shell case: see FIG. 2 in which the upper portion of the shell case contains small fragments 5 whereas the lower, diametrally opposite portion contains coarse fragments 6. By this means it becomes possible to combat with one and the same shell different types of light or heavily armoured targets in that the explosive shell is caused upon detonation to turn the appropriate side towards the target.

Figure 2:
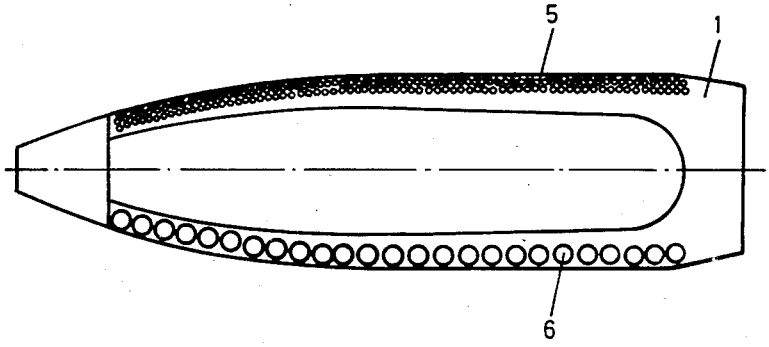
FIG. 2 shows a variant of the invention in which the prefabricated fragments are of different types in different parts of the shell case and FIG. 3 shows a variant in which the rear portion of the shell is made of a tough, high-strength material while its nose portion is made of a material with better effect properties.

Since the strength and toughness requirements imposed on the shell case are highest under and behind the driving bands different demands are imposed upon the case in different portions of the shell. In FIG. 1 and FIG. 2, the shell therefore has a greater thickness in its rear portion. Alternatively, the explosive shell case can also be made to advantage so that the rear portion is made of a tough high-strength material 7 whereas its nose portion is made of a material with better effect properties—see FIG. 3.

As previously mentioned the section under the driving band is subject to particularly high stresses. By also making the driving band 9 an integral portion of the shell case the shell wall can be retained intact under the driving band and does not need to be weakened by driving band grooves.

Figure 3:
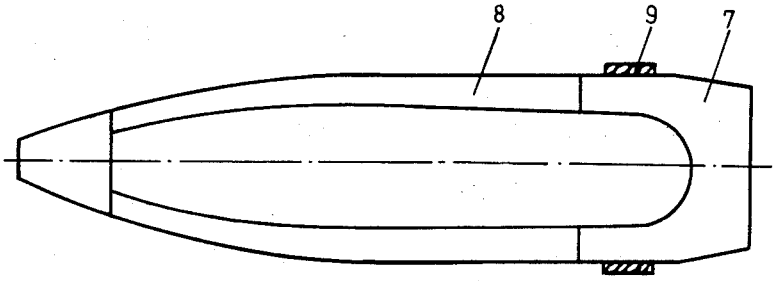

Both the variants according to FIG. 1 and FIG. 2 with a thicker case and the variant according to FIG. 3 with extra good strength properties can be elaborated to advantage with such as integral driving band.

The explosive shell according to the invention can be manufactured in different ways. It is essential for the actual shell case and the prefabricated fragments to be imparted a permanent connection with each other. This can be accomplished for instance by embedding into the shell case a jacket of prefabricated fragments or through a powder metallurgical procedure in which supporting material and fragments under high all-round pressure, for instance above 100 MPa and high temperature, for example above 1100° C., are pressed into a dense compact jacket. The driving band can also be joined to the shell case in a corresponding manner. The shell blank is then imparted its final properties through a heat treatment which obviously has to be adapted to the different material components included in the shell case. In the event that the shell case is built up of heavy metal fragments, the driving band of a soft, non-hardenable steel and otherwise of one or a plurality of hardenable steels, a heat treatment which embraces hardening from 800°–1300° C., preferably 800°–1000° C., and tempering up to 700° C., preferably 200°–400° C., is appropriate.

The invention is not restricted to the above described embodiments but can be varied within the framework of the following patent claims.

What is claimed is:

1. A hollow fragmentation jacket for a shell with improved fragmentation effect having a cylindrical wall for enclosing an explosive comprising a shell casing having an inner and an outer surface and a plurality of preshaped fragments embedded in the wall of said casing, said shell casing throughout the entire wall between said outer and said inner surface consisting essentially of a uniform, completely dense non-compressible material, said fragments consisting of a high density material, and wherein said fragments are metallurgically bonded to the casing material while being embedded in the wall of the casing.

2. A fragmentation jacket according to claim 1 wherein said fragments and said casing material are bonded to each other by a powder metallurgical procedure.

3. A fragmentation jacket according to claim 1 wherein said fragments and said casing are bonded to each other by a casting procedure.

4. A fragmentation jacket according to claim 1 wherein the material of said shell casing consists of a hardenable steel.

5. A fragmentation jacket according to claim 4 wherein said fragments in said shell casing are adjacent to the outer surface of said shell casing.

6. A fragmentation jacket according to claim 5 wherein said shell casing comprises a rear portion and a nose portion and having a driving band located around the exterior surface of said rear portion, wherein said fragments consist of balls, and wherein the thickness of said shell casing substantially corresponds to the diameter of said ball in said nose portion and increases in said rear portion.

7. A fragmentation jacket as claimed in claim 1, wherein one semi-circular portion of the shell casing contains small fragments whereas the other diametrally opposite semi-circular portion contains coarser fragments.

8. A fragmentation jacket as claimed in claim 1, wherein said rear portion of said shell casing is made of a tough, high-strength material and in which its nose portion is made of a material with better effect properties.

9. A fragmentation jacket as claimed in claim 1, wherein the driving band is an integral part of said shell casing material.

* * * * *